United States Patent [19]

Barron

[11] Patent Number: 4,556,218

[45] Date of Patent: Dec. 3, 1985

[54] ELEVATED COURT GAME APPARATUS

[76] Inventor: David J. Barron, 17 Lakewood Dr., Dunedin, Fla. 33528

[21] Appl. No.: 615,220

[22] Filed: May 30, 1984

[51] Int. Cl.[4] ..... A63B 39/00

[52] U.S. Cl. ..... 273/30; 273/58 A; 273/76; 273/411

[58] Field of Search ..... 273/411, 29, 58 C, 61 R, 273/61 A, 73 R, 58 BA, 76, 30; 272/3

[56] References Cited

U.S. PATENT DOCUMENTS

| | | | |
|---|---|---|---|
| 14,832 | 3/1820 | Saunders | 273/61 R |
| 1,509,025 | 9/1924 | Patterson | 273/61 R |
| 2,191,287 | 2/1940 | Perryman | 273/76 |
| 2,202,398 | 6/1940 | Eaton | 272/3 |
| 2,781,194 | 2/1957 | Sistrunk | 273/30 |
| 3,383,108 | 5/1968 | Reilly, Jr. | 272/3 |
| 3,622,156 | 11/1971 | Pugsley | 273/30 |
| 3,655,187 | 4/1972 | Pugsley | 273/30 |
| 3,717,343 | 2/1973 | Hartford | 273/30 |
| 3,875,996 | 4/1975 | Kohorn et al. | 272/3 |
| 4,062,541 | 12/1977 | Marks | 273/73 R |
| 4,198,042 | 4/1980 | Olson | 272/3 |
| 4,463,951 | 8/1984 | Kumasaka | 273/58 BA |

FOREIGN PATENT DOCUMENTS

| | | | |
|---|---|---|---|
| 10643 | of 1902 | United Kingdom | 273/30 |

*Primary Examiner*—Richard C. Pinkham
*Assistant Examiner*—T. Brown
*Attorney, Agent, or Firm*—Ronald E. Smith

[57] ABSTRACT

A game played on an elevated, rectangular court. The game ball has a resilient core, preferably foam, that is covered by a thin layer of rubber which in turn is covered by a hard or soft plastic material. A transversely disposed net bisects the court mid-length thereof, and a dead space is provided on both sides of the net, adjacent therto, so that when the ball falls on such dead space it does not bounce well. The court surface is larger than and thus overhangs a base member having a height that substantially defines the height of the court. Racquet members are employed by the players of the game to effect reciprocation of the ball between the players, and the ball is put into play from behind a service line that is spaced from the elevated court. In a second embodiment, the core of the game ball is hollow.

3 Claims, 6 Drawing Figures

ELEVATED COURT GAME APPARATUS

BACKGROUND OF THE INVENTION

1. Field of the Invention.

This invention relates, generally, to ball games played on a court, and more specifically relates to such a game wherein the court is elevated relative to the ground.

2. Description of the Prior Art.

A search of United States patents that was conducted prior to the filing of this disclosure located the following patents in the general field of this invention:

| Patentee | U.S. PAT. No. | Date of Issue |
|---|---|---|
| Minshull et al. | 3,468,536 | 09/23/69 |
| Young | 4,010,952 | 03/08/77 |
| Castellucci | 4,030,734 | 06/21/77 |
| McCune | 4,037,838 | 07/26/77 |
| Gieria | 4,088,317 | 05/09/78 |

As is clear from the state of the art, there are a number of games that employ apparatus for striking a ball on a court divided by a net. However, the games that are known do not completely satisfy those who play such games. For example, the game of tennis is played on a very large court and thus requires a large amount of space. Only a privileged few are able to afford enough land to construct private tennis courts thereon. Public tennis courts are well known to be crowded. As a result, many persons desiring to play the game of tennis simply are unable to do so as often as they would like to do so. The game of table tennis, on the other hand, is a game requiring a high level of skill, but the players do not normally enjoy the athletic exertions often experienced by tennis players.

Therefore, there is a need for a game that is relatively strenuous like tennis, but which does not require the large amount of space required by tennis.

As shown by the state of the art, the needed game simply does not exist.

SUMMARY OF THE INVENTION

The longstanding but heretofore unfulfilled need for a game that desirably requires small amounts of space while still allowing its participants to exert themselves to a satisfying extent is now provided in the form of a game played on an elevated court. The court is rectangular and is supported by a pedestal member having a rectangular configuration, but having smaller dimensions than the court it supports, thereby providing an overhang area about the periphery of the court.

The elevated court is divided into halves by a transversely disposed net. The game ball is of novel construction and comprises a rubber-type ball having a foam core and covered by a plastic material. The ball is struck by novel racquet members formed primarily of wood covered with a layer of rubber.

The ball is placed into play by a server who strikes the ball with the racquet in a manner similar to a tennis serve. The serve is made while the server is standing in a service area. The service area is defined at least in part by a service line that is longitudinally spaced from the end of the elevated court.

It is therefore seen to be the primary object of this invention to provide a court game that may be owned and played by persons not owning large amounts of land.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
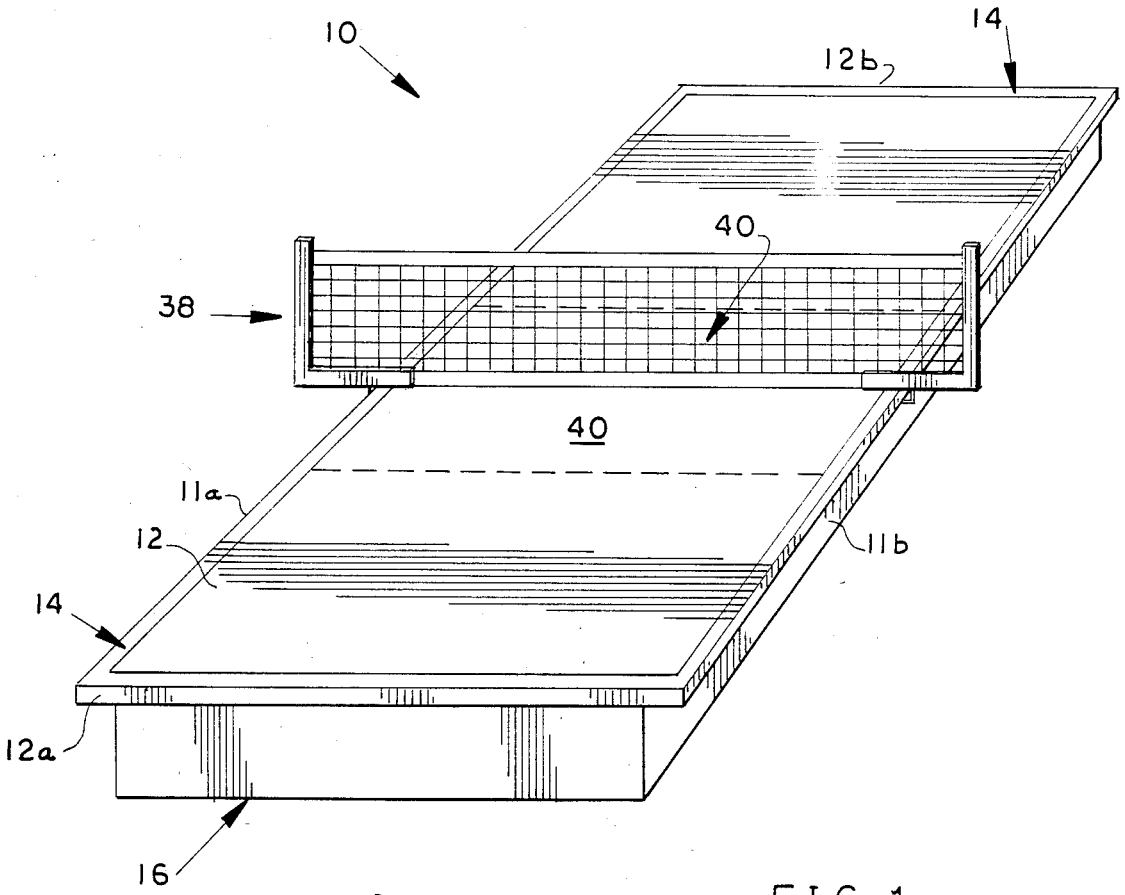
FIG. 1 is a perspective view of the novel court, showing the elevated playing surface, the pedestal supporting such playing surface, and the net.

Referring now to FIG. 1, it will there be seen that the novel court is generally designated 10. The court 10 includes a rectangular top surface or playing surface 12 of a first color and a marginal edge 14 of a second, contrasting color disposed in surrounding relation to the surface 12 at the peripheral boundaries thereof as shown. Top surface 12 is the surface upon which the game is played. The playing surface 12 is preferably formed of wood and covered with a thin layer of vinyl or other suitable resilient surface.

A rectangular base member or pedestal 16 supports the court 10, and its longitudinal and transverse dimensions are less than the respective dimensions of the court 10. Thus, if required, a player can stand immediately adjacent the surface 12, free of any interference from the pedestal 16. The amount of overhang may vary, but in a contemplated commercial embodiment of the invention, the base is eighteen feet in length and nine and one-half feet in width, whereas the playing surface 12 is twenty feet in length and ten feet in width. Accordingly, a one foot overhang is provided at the respective ends 12*a*, 12*b* of the playing surface 12, and a three inch overhang is provided at the respective sides 11*a*, 11*b* thereof. The pedestal 16 is about twelve inches in height, and since the playing surface 12 is about one inch thick, it should be understood that the playing surface 12 is just over one foot above the ground 13 (FIG. 4) which ground supports said pedestal 16.

Figure 2:
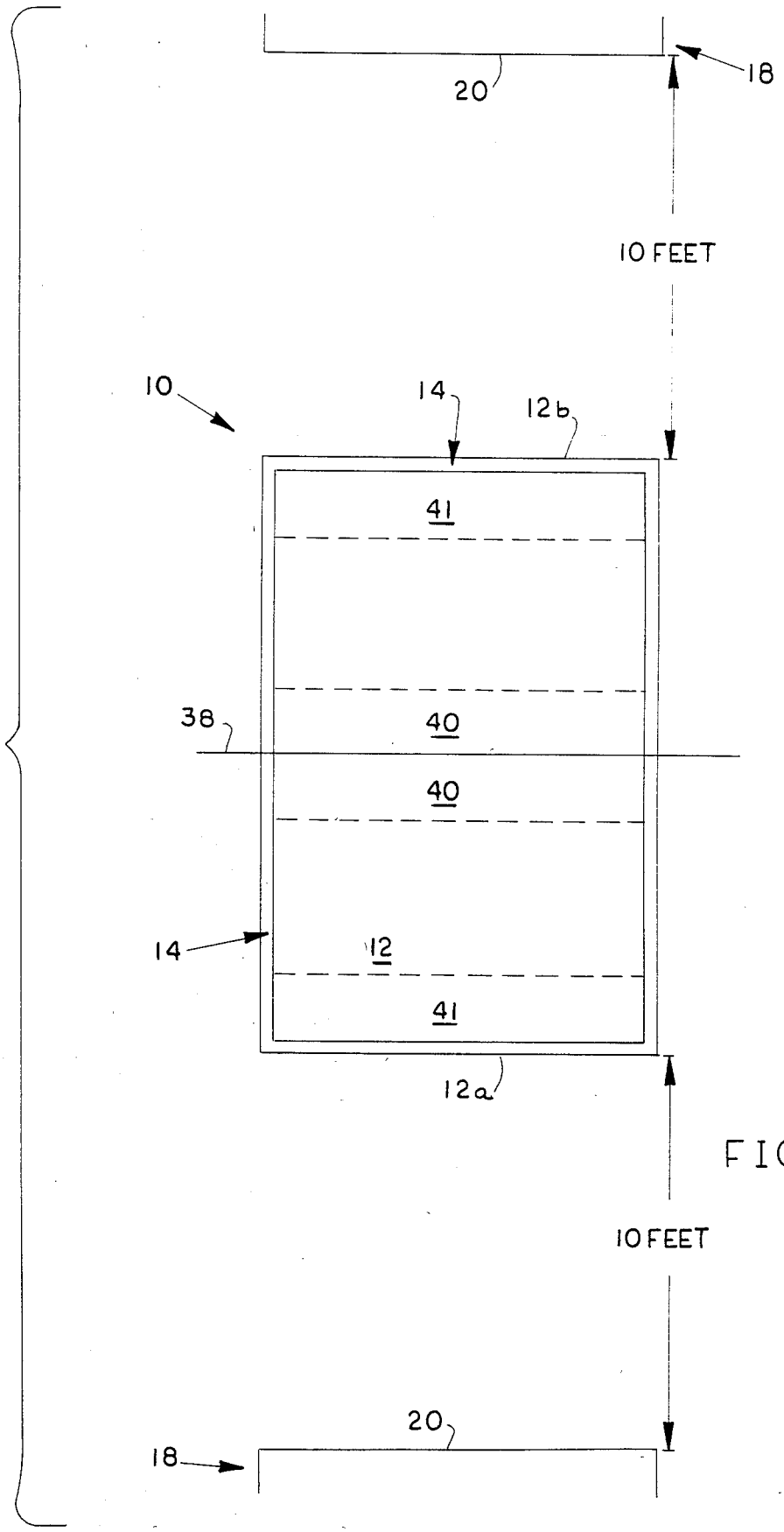
FIG. 2 is a top plan diagrammatic view of the inventive apparatus, showing how the service zone is spaced apart from the elevated court.

As depicted in FIG. 2, a service zone or area 18 has a width corresponding to the width of the playing surface 12 and includes a service line 20 that defines the forwardmost (relative to the court) border of the service zone 18. The contemplated distance between the respective transversely aligned end walls 12*a*, 12*b* of the playing surface 12 and the respective service lines is ten feet. When the game is played, the ball described hereinafter is put into play by striking the same with a racquet to be described hereinafter while the player performing the service stands anywhere within the service zone 18. If the server steps on or over the service line 20 when accomplishing a serve, a fault is declared. A double fault scores a point for the opponent.

Figure 3:
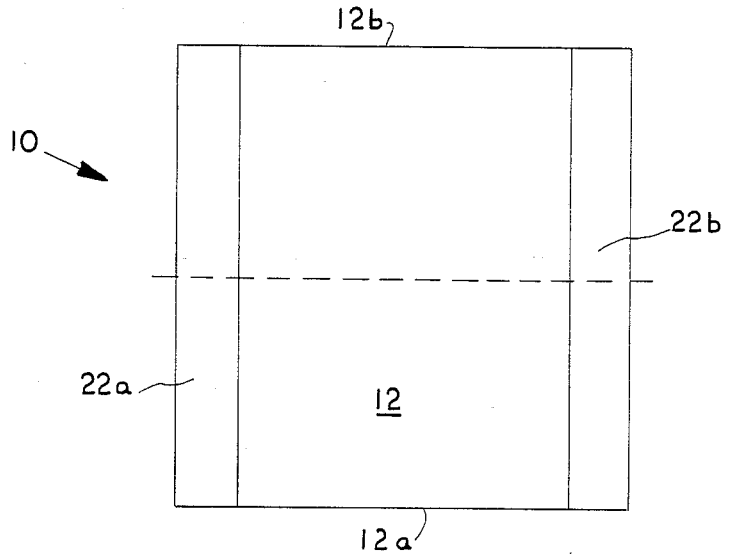
FIG. 3 is a top plan view showing an alternative embodiment of the invention employing foldable wing members that extend the lateral dimension of the court when deployed.

As shown in FIG. 3, the court 10 is provided with a pair of foldably mounted wing members 22*a*, 22*b* at its opposite sides, which wing members extend the length of the court. Each wing is preferably one foot in width, and when operatively deployed, the wings serve to widen the court from ten feet to twelve feet, although similar dimensions are, of course, within the comtemplation of this invention. The wings are deployed only in "doubles" competition.

Figure 4:
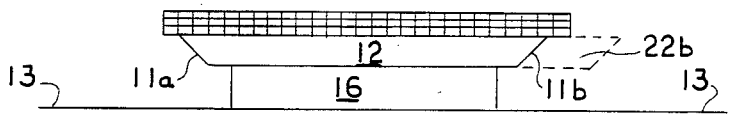
FIG. 4 is an end view of the embodiment shown in FIG. 3.

FIG. 4 shows an embodiment where the side edges 11*a*, 11*b* of the playing surface 12 are beveled inwardly to more sharply define the marginal edges of the court. A ball nipping an edge is considered to be in play.

Figure 5:
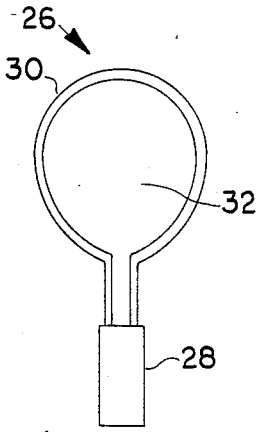
FIG. 5 is a diagrammatic view of the novel racquet member.

The novel racquet is shown in FIG. 5 and is generally designated 26. The racquet 26 includes a manually grippable handle 28, a frame 30, preferably formed of aluminum, and a flat ball-striking surface 32 preferably formed of wood. The overall length of a contemplated commercial embodiment of the paddle 26 is twelve to fourteen inches; the handle portion 28 thereof is five to six inches in length, and the frame and ball-striking surface 30, 32 collectively have a diameter of approximately seven inches. A thin (4.0–5.0 mm thick) layer of rubber covers the wooden substrate of the racquet 26 (the substrate has a contemplated thickness of one-quarter to three/eighths inch).

Figure 6:
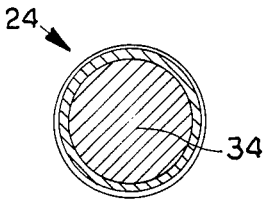
FIG. 6 is a sectional view of the novel ball.

The novel ball 24 is shown in section in FIG. 6 and has an overall diameter of approximately two and one-quarter inches and includes a foam core 34 that is covered with a first layer of rubber and a second thin layer of plastic 36. In another embodiment, the core 34 is eliminated and the ball is hollow.

The game is played by two opposing players (or four opposing players if "doubles" are being played). The players oppose each other at opposite ends of the court and are separated by the court and by the net 38 which stands fourteen to eighteen inches high and is slightly wider than the court itself, as shown in FIG. 4.

The game begins when a server stands behind service line 20 and serves the ball 24 by striking it with racquet 26 in a tennis-like sequence. The ball 24 is required to clear the net 38 on a continuous flight from the paddle and to bounce no more than once on the opponent's end of the court. A double bounce on a serve or any other part of the game is scored as a point in favor of the player to whom the ball had been hit. Let serves are played like any other serve. The receiver of the serve must then return the ball on a continuous flight from his or her racquet to the server's court, where the returned ball is required to bounce only once prior to its return.

The height of the pedestal is about one foot so that the playing surface is slightly more than one foot above the ground, as aforesaid. The players are prohibited from standing on the playing surface.

A dead space 40, depicted in FIGS. 1 and 2, is provided on the playing surface 12, immediately adjacent both sides of the net 38. Balls landing on this area 40 will bounce poorly. Since a double bounce scores a point for the player to whom the ball had been hit, the provision of the dead space 40 is thus understood to provide an incentive to the players to avoid shots that just barely clear the net 38. This avoids the need for players to get onto the playing surface 12 in order to return such shots.

Another novel feature is the provision of a double bounce zone 41 (FIG. 2) that is provided adjacent the longitudinally spaced ends of the court. As explained above, a double bounce normally scores a point for the receiver of the ball that bounced twice. However, if the second bounce falls in the double bounce zone 41, which is easily accessible by the receiver, then such second bounce is counted as a point in favor of the server. The double bounce zone 41, in conjunction with the dead space zone 40, cooperate to provide a unique incentive to the players to make all of their shots clear the net by a substantial margin (to avoid a double bounce in dead space 40), while allowing one to execute a shot having a second bounce as long as the shot is made so that the second bounce occurs in the space 41 reserved therefor.

Accordingly, it is clear that players playing the novel game may exercise strenuously throughout the course of the game, as if they were playing tennis. However, due to the relatively small size of the court, the game can be enjoyed even by persons not owning enough land to install a tennis court thereon. The novel ball will provide a unique athletic experience to the players, as will the elevated nature of the court upon which the game is played.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. An apparatus for playing a game of the type where the players of the game stand adjacent the apparatus or move about relative to the apparatus during the playing of the game, comprising, an integrally formed, flat, relatively thin, generaly rectangular in configuration, playing surface, support means for rigidly supporting said playing surface in vertically spaced, horizontally disposed relation to the ground or other flat support surface upon which the players stand or move about in the course of the game, said support means comprising a relatively thick base member of generally rectangular configuration, said base member having a thickness, or height, of approximately one foot, said base member having a flat bottom surface that abuttingly engages the ground or other flat support surface, said playing surface, accordingly, being disposed approximately one foot above the ground or other support surface, said base member having length and width dimensions less than the corresponding length and width dimensions of said playing surface to provide an overhang of said playing surface relative to said base member on all sides of said apparatus, a ball member adapted to bounce on said playing surface, said ball member having a core surrounded by a layer of rubber surrounded by a plastic covering, a racquet member for striking said ball, a transversely disposed net member disposed in bisecting relation to said playing surface, means to attenuate the amplitude of bounce of a ball member landing near said net member, said attenuation means provided in the form of a relatively soft area of said playing surface disposed substantially mid-length of said playing surface upon which said ball member bounced poorly, said soft area being generally rectangular in configuration and being disposed substantially in registration with said net so that it is bisected by said net, said soft area being imperforate and being flat so that a ball member bouncing thereon reacts against such soft area in the same manner that such ball member reacts against the playing surface, with the only difference in reaction being an attenuation in the amplitude of the bounce of the ball member, said soft area being coplanar with said playing surface so that a ball member landing upon said soft area will remain in play despite the poor bounce caused by said soft area and so that the path of travel of a ball member landing on a point of demarcation between said soft area and the playing surface will not be deflected or changed by landing on such point of demarcation.

2. The apparatus of claim 1, further comprising, a service area spaced from said playing surface within which a player must stand while serving said ball member, a service line defining the forwardmost portion of said service area, across which line said player cannot cross during said service, said service line having a rectilinear configuration, said service line being parallel to the transverse edges of said playing surface and hence normal to the longitudinal edges thereof, and said playing surface of said apparatus including only that portion of the apparatus supported by said base member.

3. The apparatus of claim 2, wherein the longitudinal edges of the playing surface are beveled inwardly.

* * * * *